United States Patent [19]

Wade

[11] 4,359,018

[45] Nov. 16, 1982

[54] ENGINE CAMSHAFT AND PISTON LUBRICATION

[75] Inventor: Calvin E. Wade, Madison Heights, Mich.

[73] Assignee: General Motors Corporation, Detroit, Mich.

[21] Appl. No.: 214,621

[22] Filed: Dec. 10, 1980

Related U.S. Application Data

[63] Continuation of Ser. No. 25,277, Mar. 29, 1979, abandoned.

[51] Int. Cl.[3] ..... F01M 1/06

[52] U.S. Cl. ..... 123/90.34; 123/90.33

[58] Field of Search ..... 123/90.33, 90.34, 90.37, 123/90.38, 196 R; 184/11 A

[56] References Cited

U.S. PATENT DOCUMENTS

| | | | |
|---|---|---|---|
| 1,428,177 | 9/1922 | Mead . | |
| 1,710,121 | 4/1929 | Smith | 184/11 A |
| 2,074,373 | 3/1937 | Dayes . | |
| 2,139,549 | 12/1938 | Kishline . | |
| 2,893,358 | 7/1959 | Bauer | 123/196 R |
| 3,014,554 | 12/1961 | Etchells | 123/196 R |
| 3,313,284 | 4/1967 | Polidan . | |
| 3,412,720 | 11/1968 | Binder . | |
| 3,428,034 | 2/1969 | MacAfee | 123/196 R |
| 3,635,311 | 1/1972 | Kaufman | 184/11 A |
| 3,875,908 | 4/1975 | Ayres | 123/90.37 |
| 3,958,541 | 5/1976 | Lachnit | 123/90.34 |

OTHER PUBLICATIONS

Automobile Engineer, May 1966, p. 167.

Engine Design Portfolio, 1961 Pontiac V-8, AI, Oct. 1, 1960.

Engine Design Portfolio, 1965 Dodge and Plymouth "273", V-8, AI, Aug. 15, 1964.

*Primary Examiner*—Ronald H. Lazarus

*Attorney, Agent, or Firm*—Robert J. Outland

[57] ABSTRACT

Gutter forming ribs are arranged on the valley walls of a V-type internal combustion engine to intercept excess lubricant passing downwardly to the oil sump and direct it first to the individual valve actuating cams of the camshaft for lubricating the cams and second to the lower portions of the piston skirts extending below their respective cylinders at the bottom of their travel to lubricate the piston skirt and cylinder walls.

3 Claims, 8 Drawing Figures

ENGINE CAMSHAFT AND PISTON LUBRICATION

This is a continuation of application Ser. No. 25,277, filed Mar. 29, 1979, now abandoned.

TECHNICAL FIELD

This invention relates to internal combustion engines and more particularly to the lubrication of components such as camshaft valve actuating cams and piston skirts in such engines. In its more specific aspects the invention provides gutter forming ribs in the valley walls of a V-type internal combustion engine to direct excess lubricant to the cams and piston skirts for adequate lubrication thereof.

BACKGROUND OF THE INVENTION

It is conventional in V-type internal combustion engines to provide a cylinder block having walls defining two V arranged banks of cylinders with a valley between the banks and a crank chamber below. Pistons are provided in the cylinders which have skirts engaging the cylinder walls, the pistons being connected with a crankshaft for reciprocation in the cylinders. The cylinders are commonly provided with valves controlling access to the combustion chambers and with means for actuating the valves that are engageable with the cams of a camshaft longitudinally arranged in the valley between the banks and driven by the crankshaft. Further, it is usual to provide a pressure lubrication system through which lubricating oil is delivered from an oil sump below the engine crank chamber to the moving parts of various components of the valve actuating means, the excess oil being directed back to the sump, at least in part, through an open passageway through the valley between the cylinder banks, running along the walls thereof before dropping through the crank chamber to the oil sump.

In engines of the type described above, some means either specially provided or inherently existing are relied upon for lubrication of the camshaft cams which actuate the valve mechanism and for lubrication of the cylinder walls and piston skirts which reciprocate within the cylinders in engagement with the walls. In some cases, lubrication of these components is adequately taken care of by the throw off or splash of oil from rotation of the engine crankshaft and the mechanism attached thereto. In other cases, separate pressure lubricating devices have been provided for spraying oil onto the camshaft cams and the cylinder walls or the piston skirts in order to provide adequate lubrication to these parts. The provision of such additional lubricating means generally adds to the cost of manufacture of an engine and is therefore resorted to only in cases where adequate lubrication is not provided by the crankshaft throw off and splash oil distributed within the engine crank chamber and commonly penetrating upwardly into the cylinder bank valley.

SUMMARY OF THE INVENTION

The present invention provides novel means for the lubrication of moving parts of an engine within and below the valley portion of the cylinder block between the cylinder banks. In particular, the invention provides means for lubricating the cams of a camshaft located within the valley and the skirts of pistons which extend below their respective cylinders at the lower portions of their strokes into a portion of the crank chamber below the valley. The improved arrangement utilizes a system of gutter forming ribs cast integral with the walls of the valley at suitable locations such as around the valve lifter carrying lifter gallery immediately above the camshaft as well as on the valley walls near their lower ends immediately above the bottoms of the respective cylinders. The provision of gutters through cast-in ribs in the manner described in accomplished with little or no additional cost since it is accomplished during the initial casting of the cylinder block.

These and other features and advantages of the invention will be more fully understood from the following description of a preferred embodiment taken together with the accompanying drawings.

BEST MODE FOR CARRYING OUT THE INVENTION

Figure 1:
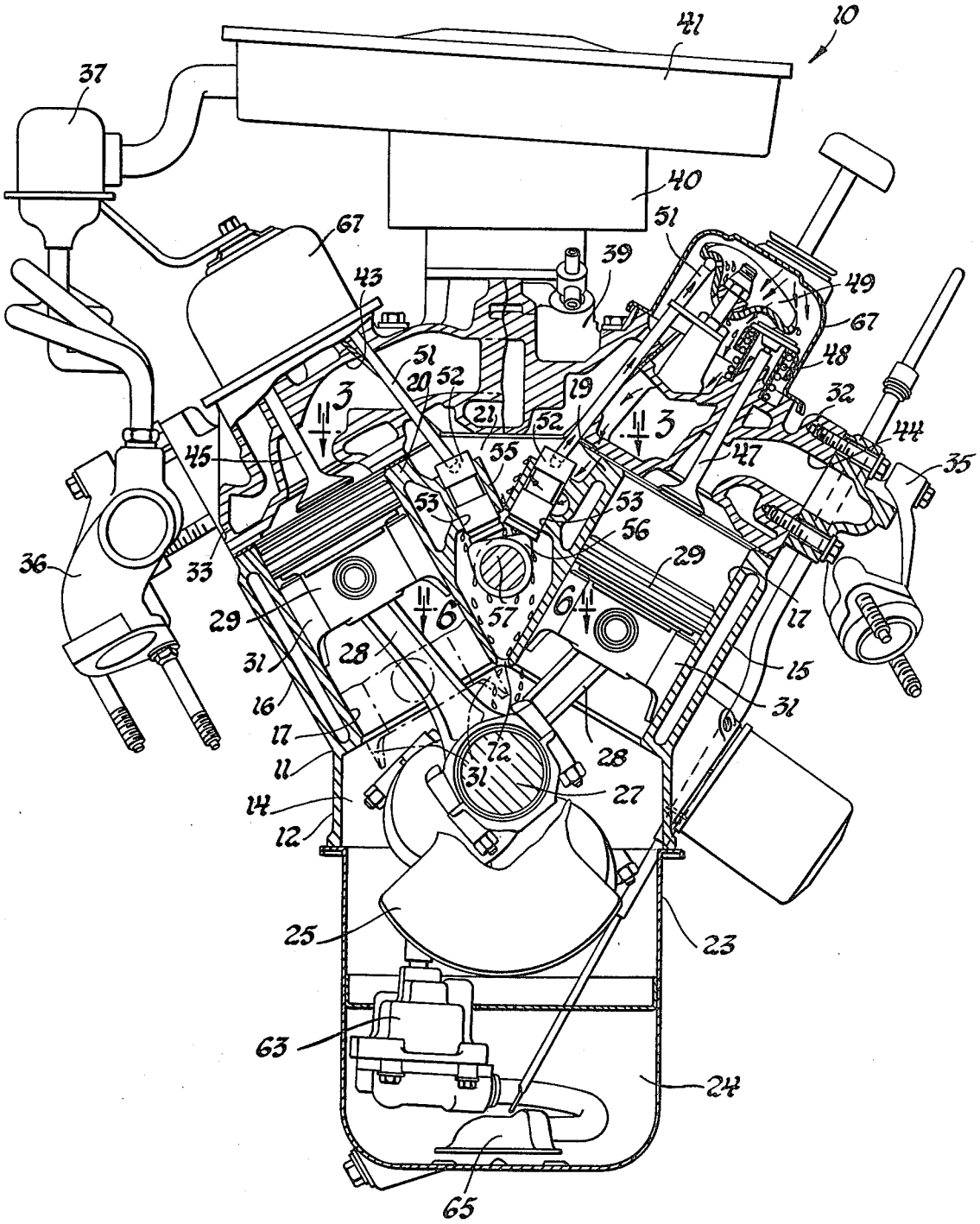
FIG. 1 is a transverse cross-sectional view of a V-type internal combustion engine having lubrication means in accordance with the invention.

Referring now to the drawings in detail, numeral 10 generally indicates a six cylinder V-type internal combustion piston engine intended primarily for automotive vehicle application. Engine 10 includes a cast and machined cylinder block 11 including a lower crankcase section 12 defining a crank chamber 14 and supporting thereabove left and right hand banks 15 and 16, respectively, of cylinders (as viewed from the rear of the engine opposite the direction of the view of FIG. 1). The cylinder banks 15, 16 are arranged in V fashion with a 60° bank angle. The inner walls 19, 20 of the left and right hand cylinder banks, respectively, define a generally V shaped open section intermediate the cylinders that is commonly referred to as the valley 21.

An oil pan 23, mounted on the bottom of the crankcase section 12 of the cylinder block, provides a sump 24 for containing a supply of lubricating oil for the engine and encloses the lower part of the crank chamber 14. A crankshaft 25 is rotatably supported in conventional fashion by the cylinder block within the crank chamber and includes a plurality of crank throws 27 connected by connecting rods 28 to pistons 29 reciprocably movable within each of the six cylinders 17 of the engine.

Figure 2:
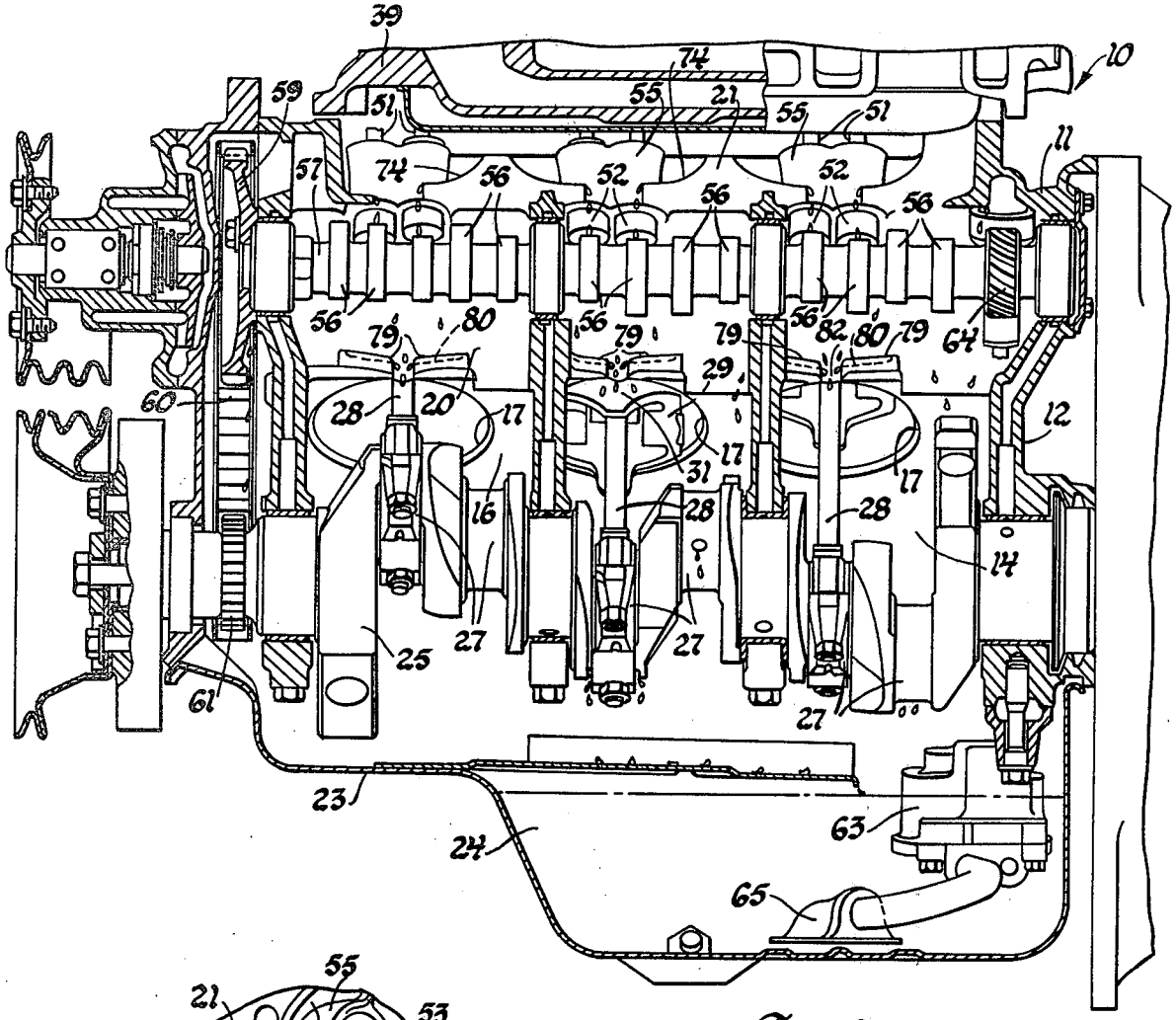
FIG. 2 is a longitudinal view of the engine of FIG. 1 showing certain features of the lubrication means.
Figure 3:
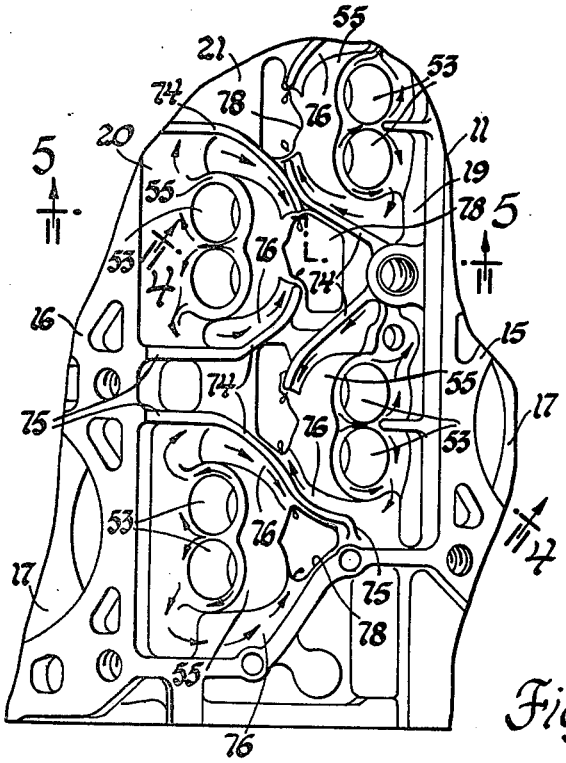
FIG. 3 is a fragmentary top view of a portion of the engine block as viewed from the plane indicated by the line 3—3 of FIG. 1 and illustrating features of the camshaft lubrication means.
Figure 4:
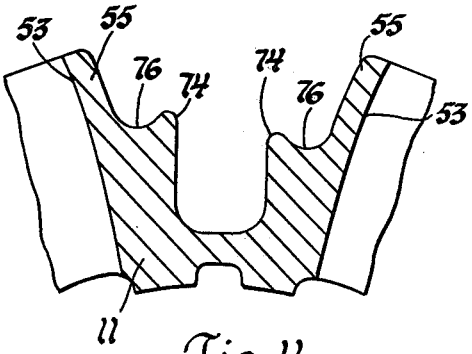
FIG. 4 is a fragmentary cross-sectional view from the plane of line 4—4 of FIG. 3 and illustrating the shape of the upper gutter forming ribs.
Figure 5:
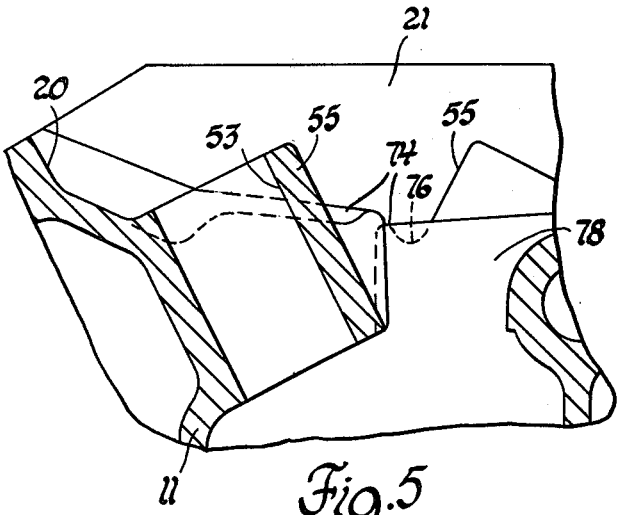
FIG. 5 is a fragmentary cross-sectional view from the plane of line 5—5 of FIG. 3 further illustrating the upper rib configuration.
Figure 7:
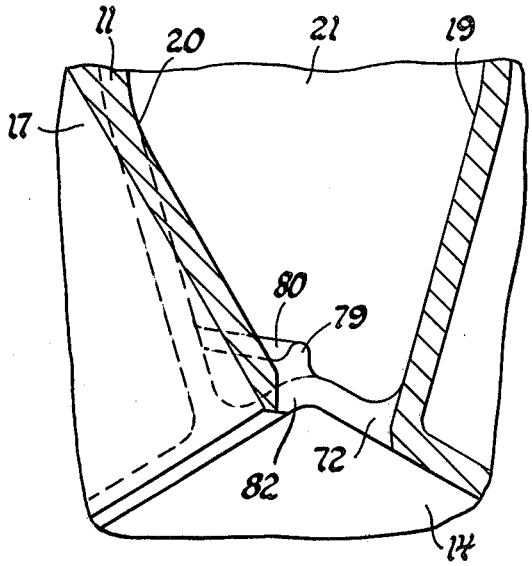
FIG. 7 is a fragmentary cross-sectional view from the plane of line 7—7 of FIG. 6 showing the configuration of the lower gutter forming ribs.
Figure 6:
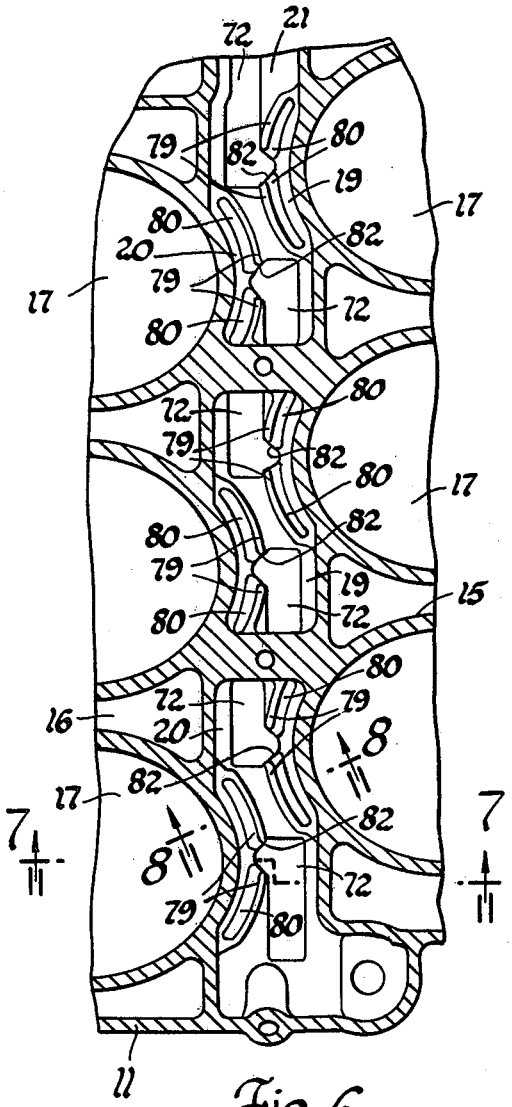
FIG. 6 is a fragmentary cross-sectional view of the engine block looking downwardly from the plane of line 6—6 of FIG. 1 and illustrating features of the piston skirt lubricating means.
Figure 8:
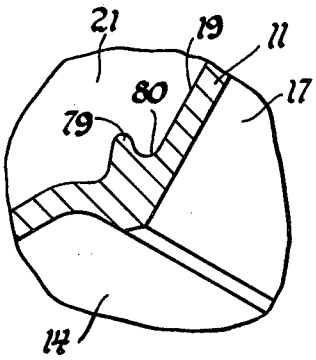
FIG. 8 is a fragmentary cross-sectional view from the plane of line 8—8 of FIG. 6 further illustrating the lower rib configuration.

The pistons each include skirts 31 which engage the walls of their respectively cylinders 17 and form bearing surfaces through which the thrust loads acting between the pistons and the cylinder walls are carried. Upon rotation of the crankshaft, the pistons reciprocate in their respective cylinders moving between upper and lower dead center positions, the latter being such that the lower portions of the piston skirts 31 extend below the lower edges of their respective cylinders into the upper portion of the crank chamber. This is illustrated by phantom lines with respect to the piston shown in the right hand cylinder bank 16 of FIG. 1 as well as by solid lines for that of the center cylinder shown in FIG. 2.

The upper ends of the cylinders 17 are closed by left and right bank cylinder heads 32, 33 mounted respectively on the upper ends of the cylinder banks 15, 16. The cylinder banks conventionally carry outboard mounted exhaust manifolds 35, 36 which may be supplied with secondary air through air supply valves 37, only one of which is shown. An intake manifold 39 mounted between the cylinder heads 32, 33 covers the open top of the valley 21 and in turn supports a carburetor 40 on which an air cleaner 41 is mounted.

The cylinder heads are provided with inlet and exhaust ports 43, 44, respectively, for communicating their respective cylinders with the intake and exhaust manifolds and other portions of the engine intake and exhaust systems. The respective ports are controlled by inlet and exhaust valves 45, 47, respectively, which are actuated by suitable valve gear including valve springs 48, rocker arms 49, pushrods 51 and hydraulic valve lifters 52, the latter being carried in the bores 53 of bosses 55 formed as extensions of the valley walls 19, 20 and defining a valve lifter gallery. The valve lifters 52 are actuated by the cams 56 of a camshaft 57 which is rotatably supported in the cylinder block, extending longitudinally through the valley 21 below the lifter gallery bosses 55. A driven gear 59 connects through a chain 60 with a drive gear 61 on the crankshaft, thus providing a driving connection for the engine camshaft.

ENGINE LUBRICATION

The engine 10 is provided with a pressure lubrication system including an oil pump 63 driven from the distributor drive gear 64 located near the rear end of the camshaft and connected with an intake strainer 65 through which oil is drawn by the pump from the engine oil sump. The pump directs oil through various passages in the engine block and moving components to lubrication points including the various bearing journals of the crankshaft and camshaft. Oil is also supplied directly to the valve lifters 52 and from them through the pushrods to the rocker arms 49 which are enclosed by rocker covers 67 mounted on the tops of the cylinder heads and the adjacent intake manifold. The oil used in lubricating the valve gear components, as well as the excess oil supplied thereto, is returned to the engine sump by gravity impelled flow downwardly along upper and inner surfaces of the cylinder heads, through the open pushrod spaces defined between the cylinder heads and the intake manifold and into the valley 21, running along the walls 19, 20 thereof to the lower inner edge of the cylinders at which point openings 72 are provided through which the oil passes into the crank chamber and thence is returned to the oil sump below.

Along the walls 19, 20 there are provided upper and lower groups of gutter forming ribs arranged especially to intercept the excess lubricating oil being returned from lubrication of the upper portions of the valve gear and passing downwardly along the valley walls and to direct this oil onto the cams 56 of the camshaft and subsequently, at least in part, onto the inner skirts 31 of the various pistons in order to provide for adequate lubrication of the cams, piston skirts and the associated cylinder walls. The upper gutter forming ribs 74, as best shown in FIGS. 2–5, are seen to extend from points 75 near the upper edges of the cylinder block downwardly around the lifter gallery bosses 55, with one set of ribs being provided at each cylinder location. Each set of the upper ribs is arranged to intercept a major portion of the returning oil utilized for lubricating the components of its respective cylinder location. This oil is directed downwardly through gutters 76 extending around the sides of the lifter gallery bosses 55, the gutters terminating at point along openings 78 immediately above the respective cams 56 of the camshaft, so that the collected oil is directed onto the surfaces of the cams for lubrication thereof.

Moving further downwardly along the sides of the valley walls 19, 20, some of the oil passing the upper ribs, in addition to that used for lubricating the camshaft bearings, is intercepted near the lower edges of the engine cylinders by a lower set of gutter forming ribs 79 best shown in FIGS. 2 and 6–8. Ribs 79 extend longitudinally in both directions from the planes of their adjacent cylinders defining gutters 80 which collect oil from the valley wall surfaces immediately outside of their respective cylinders and direct it to V-like openings 82 formed at the lower edges of the respective valley walls which correspond to the bottom edges of the respective cylinders. From here the oil collected by the gutters is directed onto the outer surfaces of the lower portions of the piston skirts 31 when they reach the lower portions of their strokes, thus providing lubrication for both the piston skirts and their respective cylinders upon subsequent upward movement of the pistons. It should be noted that the lower group of gutter forming ribs 79 are likewise arranged to collect oil flowing down the walls at each of the various cylinder locations, which has primarily been utilized in the lubrication of operative elements of the valve gear and other moving parts associated with the respective cylinders, and to use this oil for providing adequate lubrication of the inner piston skirts 31.

By the manner of providing upper and lower groups of gutter forming ribs associated with each respective cylinder location, the present invention provides added lubrication to moving components of the engine such as the camshaft cams and piston skirts through means provided entirely as part of the engine block casting and thus obtained with a minimum manufacturing cost.

While the invention has been disclosed by reference to a specific embodiment chosen for purposes of illustration, it should be understood that numerous changes could be made without departing from the spirit and scope of the inventive concepts disclosed. Accordingly, it is intended that the invention not be limited to the specific forms shown in the disclosed embodiment but that it have the full scope provided by the language of the following claims.

The embodiments of the invention in which an exclusive property or privilege is claimed are defined as follows:

1. An internal combustion engine including a unitary cylinder block having walls defining two V arranged banks of cylinders, a valley with a valve lifter gallery between the banks and a crank chamber below, pistons in the cylinders having skirts engaging the cylinder walls, the pistons being connected with a crankshaft for reciprocation in the cylinders, valves controlling access to each of the cylinders, valve actuating means engageable with cams of a camshaft arranged longitudinally in the valley below the lifter gallery and connected with the crankshaft for rotation of the camshaft to actuate the valves, means for lubricating the valve actuating means and for directing excess lubricant down the valley walls to the crank chamber for return to an oil sump below, and the improvement comprising gutter forming ribs integral with and extending along the valley and lifter gallery walls at each cylinder location to intercept the lubricant passing down the walls at each said location and direct it to the various cams of the camshaft disposed below the lifter gallery and associated with the respective cylinder at each said location.

2. An internal combustion engine including a unitary cylinder block having walls defining two V-arranged banks of cylinders, a valley between the banks and a crank chamber below, pistons in the cylinders having skirts engaging the cylinder walls, the pistons being connected with a crankshaft for reciprocation in the cylinders with the skirts having lower portions extending below the bottoms of the cylinders at the lower extent of their travel, valves controlling access to each of the cylinders, valve actuating means engageable with cams of a camshaft arranged longitudinally in the valley and connected with the crankshaft for rotation of the camshaft to actuate the valves, means for lubricating the valve actuating means and for directing excess lubricant down the valley walls to the crank chamber for return to an oil sump below, and the improvement comprising gutter forming rib means integral with and extending along lower portions of the valley walls below the camshaft at each cylinder location to intercept returning lubricant flowing therealong and direct it to positions at the inner edges near the bottom of each respective cylinder for lubricating the associated piston skirts by delivery of the intercepted lubricant onto their skirt lower portions as they extend below their cylinders at their lower extent of travel.

3. An internal combustion engine including a unitary cylinder block having walls defining two V-arranged banks of cylinders, a valley with a valve lifter gallery between the banks and a crank chamber below, pistons in the cylinders having skirts engaging the walls, the pistons being connected with a crankshaft for reciprocation in the cylinders with the skirts having lower portions extending below the bottoms of the cylinders at the lower extent of their travel, valves controlling access to each of the cylinders, valve actuating means engageable with cams of a camshaft arranged longitudinally in the valley below the lifter gallery and connected with the crankshaft for rotation of the camshaft to actuate the valves, means for lubricating the valve actuating means and for directing excess lubricant down the valley walls to the crank chamber for return to an oil sump below, and the improvement comprising first gutter forming ribs integral with and extending along the valley and lifter gallery walls at each cylinder location to intercept the lubricant passing down the walls at each said location and direct it to the various cams of the camshaft disposed below the lifter gallery and associated with the respective cylinder at each said location, and second gutter forming ribs integral with and extending along lower portions of the valley walls below the camshaft at each cylinder location to intercept returning lubricant flowing therealong and direct it to positions at the inner edges near the bottom of each respective cylinder for lubricating the associated piston skirts by delivery of the intercepted lubricant onto their skirt lower portions as they extend below their cylinders at their lower extent of travel.

* * * * *